US012741799B2

(12) United States Patent
Maldonado et al.

(10) Patent No.: US 12,741,799 B2
(45) Date of Patent: Sep. 22, 2026

(54) INSULATED CONTAINER

(71) Applicant: Igloo Products Corp., Katy, TX (US)

(72) Inventors: John Maldonado, Katy, TX (US); James Ira McKenrick, Katy, TX (US); Jesus E. Linares, Katy, TX (US); James Verespej, Katy, TX (US)

(73) Assignee: Igloo Products Corp., Katy, TX (US)

( * ) Notice: Subject to any disclaimer, the term of this patent is extended or adjusted under 35 U.S.C. 154(b) by 0 days.

(21) Appl. No.: 18/888,698

(22) Filed: Sep. 18, 2024

(65) Prior Publication Data

US 2025/0100774 A1 Mar. 27, 2025

Related U.S. Application Data

(60) Provisional application No. 63/584,607, filed on Sep. 22, 2023.

(51) Int. Cl.
*B65D 81/38* (2006.01)
*B65D 25/28* (2006.01)

(52) U.S. Cl.
CPC ..... *B65D 81/3804* (2013.01); *B65D 25/2841* (2013.01); *B65D 81/3806* (2013.01)

(58) Field of Classification Search
CPC ..... F25D 2331/802; F25D 2331/801; F25D 2331/804; B65D 81/3876; B65D 81/3879; B65D 81/3886; B65D 25/32; A45C 11/20; B25H 3/00; A01K 97/04; A01K 97/05; A45F 2004/026
USPC ..... 220/915.2, 739
See application file for complete search history.

(56) References Cited

U.S. PATENT DOCUMENTS 1,312,626 A * 8/1919 Grannis ..... B65F 1/1615 220/322
2,610,757 A * 9/1952 Irvine ..... B65D 81/3886 383/110
2,954,891 A * 10/1960 Imber ..... B65D 81/3834 220/592.2
4,351,448 A * 9/1982 Ingersoll ..... A45C 13/28 206/508
5,772,066 A * 6/1998 Reynolds ..... A45C 11/20 220/735
D446,617 S * 8/2001 Urbanski ..... D32/53
8,251,269 B2 * 8/2012 Winneur ..... A45C 9/00 224/652

(Continued)

FOREIGN PATENT DOCUMENTS

EP 1878667 A1 * 1/2008 ..... B65D 45/04

OTHER PUBLICATIONS

EP_1878667_translation.pdf (Year: 2008).*

(Continued)

*Primary Examiner* — Allan D Stevens
(74) *Attorney, Agent, or Firm* — Dinsmore & Shohl LLP

(57) ABSTRACT

Present embodiments relate to an insulated container. More specifically, but without limitation, the present embodiments relate to a container having a hard liner and a softside exterior which may retain heated or cold food or drink items. In some embodiments, the insulated container may be in the form of a bucket and in other embodiments, the insulated container may be in the form of a cooler. The exterior of the insulated container comprises the appearance of a soft container, but has the improved rigidity of a hard container.

29 Claims, 10 Drawing Sheets

(56) References Cited

U.S. PATENT DOCUMENTS

| | | | | |
|---|---|---|---|---|
| 8,919,596 | B2 * | 12/2014 | Carino | B25H 3/02 206/315.11 |
| 11,913,707 | B2 * | 2/2024 | Gagnon | F25D 3/08 |
| 2005/0072181 | A1 * | 4/2005 | Mogil | A45C 11/20 62/457.7 |
| 2005/0263527 | A1 * | 12/2005 | Maldonado | A45C 13/40 220/592.2 |
| 2005/0279123 | A1 * | 12/2005 | Maldonado | A45C 13/02 190/18 R |
| 2012/0217255 | A1 * | 8/2012 | Connelly | B65D 81/3879 220/592.24 |
| 2012/0279976 | A1 * | 11/2012 | DeSanti | A45C 15/00 220/739 |
| 2016/0120162 | A1 * | 5/2016 | Copper | A45C 11/20 220/592.2 |
| 2019/0008264 | A1 * | 1/2019 | Furstenburg | A45F 3/04 |
| 2019/0281940 | A1 * | 9/2019 | Stephens | A45C 11/20 |
| 2022/0041335 | A1 * | 2/2022 | Rogers | B65D 81/18 |
| 2022/0194654 | A1 | 6/2022 | Seiders et al. | |
| 2023/0030665 | A1 | 2/2023 | Seiders et al. | |
| 2023/0095978 | A1 | 3/2023 | Rogers et al. | |
| 2024/0092534 | A1 | 3/2024 | Rogers et al. | |

OTHER PUBLICATIONS

PCT Application No. PCT/US2024/047212 titled "Insulated Container" filed on Sep. 18, 2024.

U.S. Appl. No. 63/584,607 titled "Insulated Container" filed Sep. 22, 2023.

European Patent Office; International Search Report and Written Opinion issued in PCT/US2024/047212 mailed Dec. 5, 2024, 13 pages.

* cited by examiner

INSULATED CONTAINER

INCORPORATION BY REFERENCE

Any and all applications for which a foreign or domestic priority claim is identified in the Application Data Sheet as filed with the present application are hereby incorporated by reference herein and made a part of the present disclosure.

BACKGROUND

1. Field of the Invention

Present embodiments relate to an insulated container. More specifically, but without limitation, the present embodiments relate to a container having a rigid inner liner and a softside exterior which may retain heated or cold food or drink items, but may also, according to some embodiments, function as a bucket to assist in numerous activities.

2. Background

Various activities ranging from fishing, to work, to kids sports events generally require carrying of necessary materials for the task. For example it may be fishing gear, work tools, food/beverage, and/or a seating device. It is often difficult to carry all of these items from a vehicle to a location where the activity is occurring. A need exists in which a single device that satisfies all of the requirements of these types of activities.

The information included in this Background section of the specification, including any references cited herein and any description or discussion thereof, is included for technical reference purposes only and is not to be regarded subject matter by which the scope of the invention is to be bound.

SUMMARY

The present application discloses one or more of the features recited in the appended claims and/or the following features which alone or in any combination, may comprise patentable subject matter.

Present embodiments relate to a container which may function as an insulated container, also commonly referred to as a "cooler" or a general container, and which is shaped like a bucket. The container may be insulated and may be used to store food or drinks, hot or cold, and includes an exterior with one or more pockets that may be used to store items. Additionally, the form factor allows for use of the bucket in a variety of ways, including for tools and for outdoor activities, work, or chore activities, in addition to the food/drink storage.

The insulated container, also generally referred to as a cooler, described herein is a bucket cooler that combines advantages of both softside and hardside coolers, and creates one solution to at least some of the disadvantages described above. The softside material provides an aesthetically pleasing appearance with an insulating function, as well as one or more pockets.

In some embodiments, the container may have a single wall or a double wall hard liner. The hard liner may or may not include an insulation. A pliable material may be attached to the outside of the container to form an integral part of the container. The pliable softside material may be nylon, polyester, polyvinyl chloride (PVC), or other similar material. In yet another embodiment, separate pliable material may be attachable to the lid and may be nylon, polyester, or other material similar to the materials typically used in a softside cooler. It should be understood that the container could be any shape, e.g. cylindrical, square, rectangular, as long as it contains a cavity, as would be appreciated by one of ordinary skill in the art having the benefit of this disclosure.

According to some embodiments, an insulated container, comprises a lid, a body, the body comprising a rigid inner liner having a bottom, a sidewall extending upwardly from the bottom, the sidewall having a first end at the bottom and a second end spaced away from the bottom; an upper opening defined by the second end of the sidewall; a collar disposed near an upper end of the sidewall, the collar forming a space between the sidewall and the collar. A skirt assembly is disposed over the rigid inner liner, the skirt assembly having a skirt ring at an upper end, the skirt ring engaging the collar, and a softside material depending from the skirt ring and covering the rigid inner liner. A handle engages the collar and the skirt ring to retain the skirt assembly in position over the insulated container.

In some embodiments, the lid covers the upper opening.

In some embodiments, the sidewall may have having one or more locating features for the lid.

In some embodiments, the insulated container may further comprise the skirt ring comprising an ear having an aperture.

In some embodiments, the ear may extend into the space formed by the collar.

In some embodiments, the insulated container may further comprise a pivot connector engaging the collar and the ear.

In some embodiments, the insulated container may further comprising one or more pockets formed on the skirt assembly.

In some embodiments, the insulated container may further comprise a foam insulation in the skirt assembly.

In some embodiments, the insulated container may further comprise the softside material being a fabric and disposed about an exterior of the foam insulation.

In some embodiments, the insulated container may further comprise one or more accessory retainers.

In some embodiments, the insulated container may further comprise accessories which connect to the one or more accessory retainers.

According to some embodiments, an insulated container comprises a body having a rigid inner liner formed of a sidewall with an upper open end and a lower end connected to the sidewall, a collar disposed at the upper open end of the sidewall, a skirt assembly having an exterior material disposed between a skirt ring and a molded base. A lid is positioned at the upper open end of the rigid inner liner. A handle having L-shaped ends which connects the handle and the body. The handle being pivotable from a first position which the lid is removable, to second and third positions wherein one of the second or third positions is for carrying and locks the lid, and the other of the second or third positions locks the lid.

In some embodiments, the insulated container further comprises a pivot connector extending through the handle and into the collar.

In some embodiments, the pivot connector may extend through the collar and the skirt ring.

In some embodiments, the skirt ring may be disposed adjacent to the collar, and have an ear which aligns with a hole in the collar to receive the pivot connector.

According to some embodiments, an insulated container may comprise a lid, a body, the lid may be pivotally connected to the body, the body comprises a rigid inner shell liner comprising an inner base and one or more sidewalls extending from the inner base. A collar may be disposed at an upper end of the one or more sidewalls and extending outwardly therefrom, the collar forming a space between an outer surface of the one or more sidewalls and the collar. A skirt assembly may comprise a skirt ring and a softshell skirt material depending from the skirt ring, the skirt ring positioned within the space wherein the softshell skirt material covers the rigid inner shell liner. A handle engages the collar and the skirt ring to retain the skirt assembly in position over the insulated container.

In some embodiments, the skirt ring may comprise a retention structure.

In some embodiments, the collar may comprise a hole which aligns with the retention structure when the skirt ring is positioned in the space.

In some embodiments, the handle may have a pivot pin which extends through the retention structure and the hole in the collar to retain the skirt ring and the softshell skirt material in position within the collar.

In some embodiments, the handle may comprise first and second buckles which pivotally connect to the body.

In some embodiments, the handle may further comprise first and second handle arms connected to the first and second buckles, respectively.

In some embodiments, the insulated container may further comprise a handlebar extending between the first and second handle arms.

In some embodiments, the lid may further comprise a softside lid material.

In some embodiments, the lid may further comprise a closure.

In some embodiments, the lid may be rectangular and the body having a corresponding rectangular shape.

In some embodiments, the handle may comprise a rigid structure or a shoulder strap.

In some embodiments, the handle may be interchangeable with a strap.

In some embodiments, the strap may have a pad.

In some embodiments, the pad may further comprise a hook which is movable relative to the pad.

This Summary is provided to introduce a selection of concepts in a simplified form that are further described below in the Detailed Description. This Summary is not intended to identify key features or essential features of the claimed subject matter, nor is it intended to be used to limit the scope of the claimed subject matter. All of the above outlined features are to be understood as exemplary only and many more features and objectives of the various embodiments may be gleaned from the disclosure herein. Therefore, no limiting interpretation of this summary is to be understood without further reading of the entire specification, claims and drawings, included herewith. A more extensive presentation of features, details, utilities, and advantages of the present invention is provided in the following written description of various embodiments of the invention, illustrated in the accompanying drawings, and defined in the appended claims.

BRIEF DESCRIPTION OF THE DRAWINGS

In order that the embodiments may be better understood, embodiments of an insulated container will now be described by way of examples. These embodiments are not to limit the scope of the claims as other embodiments of an insulated container will become apparent to one having ordinary skill in the art upon reading the instant description. Non-limiting examples of the present embodiments are shown in figures wherein:

DETAILED DESCRIPTION

Figure 1:
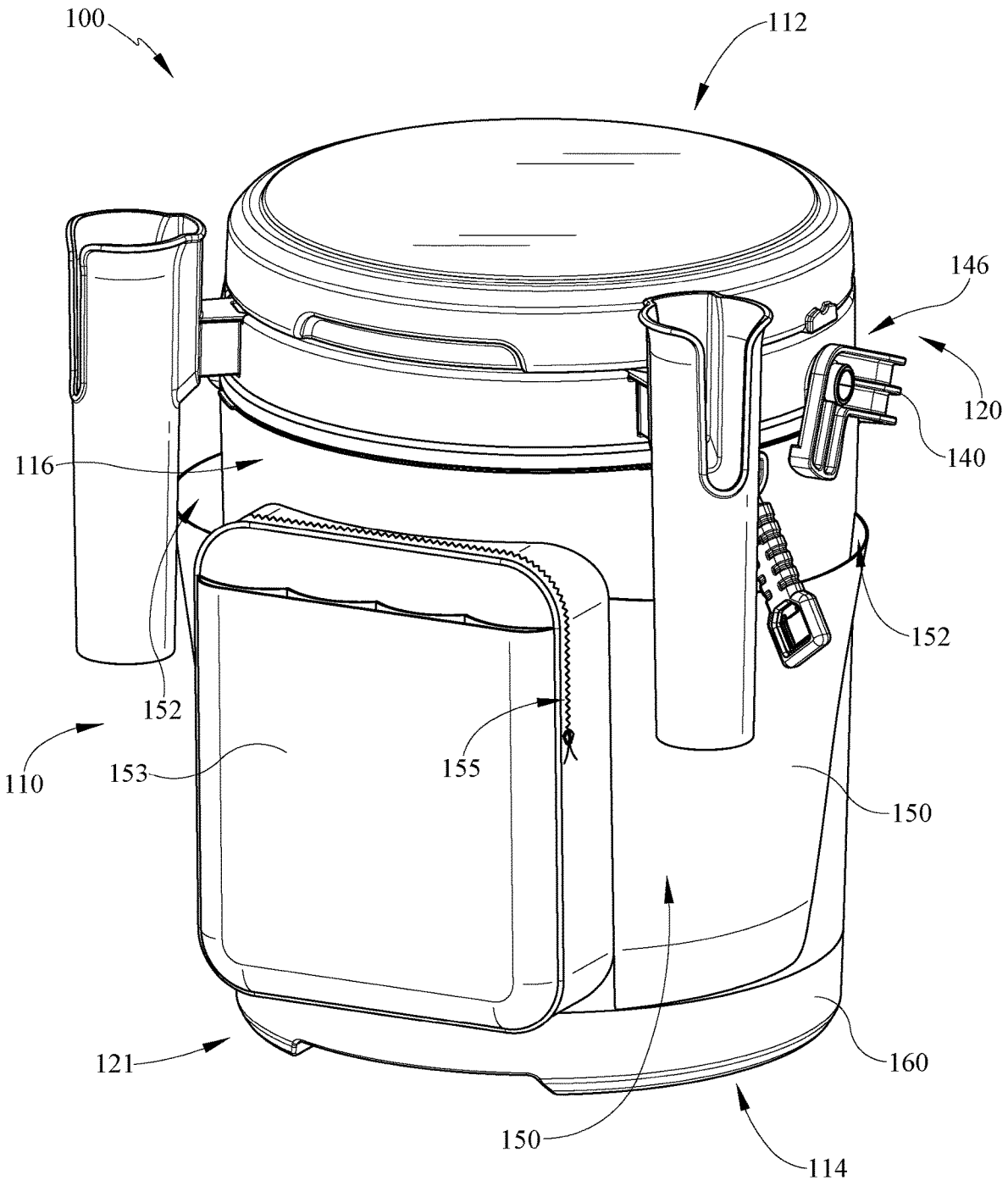
FIG. 1 is a perspective view of an insulated container.

It is to be understood that an insulated container is not limited in its application to the details of construction and the arrangement of components set forth in the following description or illustrated in the drawings. The described embodiments are capable of other embodiments and of being practiced or of being carried out in various ways. Also, it is to be understood that the phraseology and terminology used herein is for the purpose of description and should not be regarded as limiting. The use of "including," "comprising," or "having" and variations thereof herein is meant to encompass the items listed thereafter and equivalents thereof as well as additional items. Unless limited otherwise, the terms "connected," "coupled," and "mounted," and variations thereof herein are used broadly and encompass direct and indirect connections, couplings, and mountings. In addition, the terms "connected" and "coupled" and variations thereof are not restricted to physical or mechanical connections or couplings.

Reference throughout this specification to "one embodiment", "some embodiments" or "an embodiment" means that a particular feature, structure or characteristic described in connection with the embodiment is included in at least one embodiment of the present invention. Thus, appearances of the phrases "in one embodiment", "in some embodiments" or "in an embodiment" in various places throughout this specification are not necessarily all referring to the same embodiment, but may. Furthermore, the particular features, structures or characteristics may be combined in any suitable manner, as would be apparent to one of ordinary skill in the art from this disclosure, in one or more embodiments.

Referring now to FIGS. 1-12, various embodiments are provided which relate to an insulated container. The insulated container is shown in the form of a bucket shaped cooler, and may be used to store cold or hot foods or drinks. Further, the insulated container may also be used as a bucket for work or outdoor activities such as storage while fishing, or used as a seat for example. The insulated container may be in the form of a bucket with internal storage and one or more exterior pockets thus providing both internal and external storage functionality. The insulated container may be generally cylindrical in shape, but in further embodiments may be alternate shapes.

Referring now to FIG. 1, a perspective view of an insulated container 100 is shown. The insulated container 100 comprises a body 110 and a lid 112 wherein the lid 112 is removable to access the interior of the insulated container 100. In some embodiments generally, the insulated container 100 may include the body 110 defined by a bottom wall 114, and one or more sidewalls 116 extending upwardly from the bottom wall 114. The bottom wall 114 may be circular and the one or more sidewalls 116 may be continuously extending about the bottom wall 114 from a peripheral edge of the bottom wall 114. In the depicted example, the insulated container 100 comprises a bucket shape and therefore is open at an upper end 120 but may be closed with the use of the lid 112 that is removable. The open interior of the body 110 allows for storage of food, drinks, or other items which may or may not require insulation to maintain temperature. The body 110 of the insulated container 100 may comprise a softside exterior material 150, or skirt, or other soft material construction which extends between a lower end 121 and the upper end 120 of the body 110. The body 110 may also comprise a more rigid rugged bottom wall 114 or material, or a base 160 which supports the insulated container 100 on the ground or other substrate. The base 160 material may be more rigid than the softside exterior material 150 and in some embodiments, for example, may be a polyethylene or polypropylene.

The softside exterior material 150 of the insulated container 100 may comprise one or more pockets 152 which may be used for dry storage of items. The softside exterior material 150 for example is shown with, for example, a closable pocket 153 which comprises a closure 155 to open and close the closable pocket 153. Further, the softside exterior material 150 may comprise one or more open pockets 152 on either side of the closable pocket 153. Additional pockets may be located about the insulated container 100, on the softside exterior material 150. The one or more pockets 152, 153 may be a solid fabric material or may be a mesh, stretchable material, or combinations according to some non-limiting embodiments and without limitation.

The insulated container 100 further comprises the removable lid 112. The upwardly extending one or more sidewalls 116 of the body 110 may define an opening at the upper end 120. The lid 112 may be disposed at the upper end 120 of the insulated container 100 to close the open end of the body 110. The lid 112 closes access to the interior of the insulated container 100, but alternatively may be removed to access the interior, for example to obtain stored food, drinks, or other items in the insulated container 100.

The insulated container 100 may further comprise a handle 140 to carry the insulated container 100. The handle 140 may be pivotal through a range, for example about 200 degrees. The handle 140 is shown and includes L-shaped ends 146 that are each spaced apart about 180 degrees on the insulated container 100. The handle 140 may comprise one or more positions which lock the lid 112 in place on the insulated container 100 and which unlock to allow for removal of the lid 112.

Figure 2:
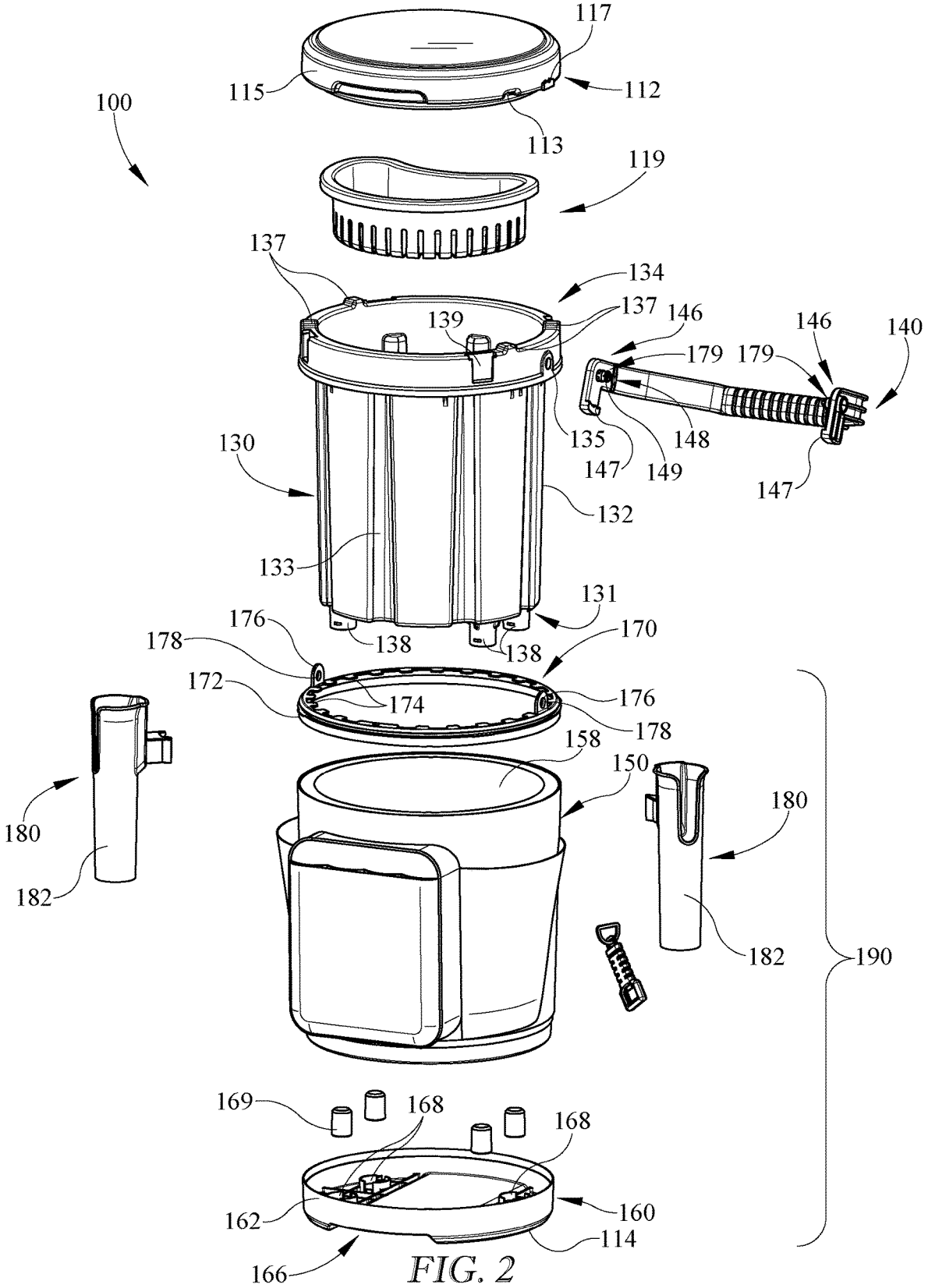
FIG. 2 is an exploded perspective view of an insulated container.

Referring now to FIG. 2, an exploded perspective view of the insulated container 100 is shown. Starting from the bottom wall 114, the insulated container 100 comprises the base 160. The base 160 may be a rigid or semi-rigid and more durable material than the more pliable softside exterior material 150, or skirt, for example polyethylene, which can withstand impact and rubbing associated with use and support of the insulated container 100. The base 160 may also be skid-resistant in some embodiments, The skid-resistant base 160 may be, for non-limiting example, formed of various types of hard plastics, adapted to provide protection to the softside exterior material 150 on the bottom wall 114 of insulated container 100. The base 160 may be formed of injection molded plastic in some embodiments. As shown, the base 160 may be attached to the softside exterior material 150 via fasteners such as screws passing through the softside exterior material 150, sewn, glue, adhesive or other manners. In some embodiments, the base 160 may comprise the bottom wall 114 and an upstanding sidewall 162. Optionally, the base 160 may comprise a channel 166 that may extend across the base to limit surface area contact with a support substrate and thereby limit heat transfer through the entirety of the base to the interior of the body 110 of the insulated container 100.

The interior of the base 160 may comprise shoes 168 which receive liner feet 138 of a rigid inner liner 130. The shoes 168 may comprise for example four hollow cylindrical structures to receive the liner feet 138. The liner feet 138 may thereby engage the base 160 to connect the base and rigid inner liner 130. This connection may provide additional structural integrity between the base and the rigid inner liner 130. The liner feet 138 are cylindrically shaped and the shoes 168 are cylindrical in shape so that one fits in the other. The base or the rigid inner liner 130 may comprise the male portion of the connection. Other connections may be provided.

Positioned above the base are four wraps 169, which engage liner feet 138 and shoe 168 connection. For example, the wraps 169 may extend about the liner feet 138 and the shoes 168 to insulate. The wraps 169 may be separate from a rigid inner liner 130 or may be formed integrally with the rigid inner liner 130. The feet wraps 169 provide insulation for the liner feet 138 and may be disposed about the liner feet 138 between the rigid inner liner 130 and the base. The wraps 169 may be formed of various materials including but not limited to polyurethane foam to wrap and insulate the liner feet 138. In some alternatives, an additional insulation may be disposed between the base and a rigid inner liner 130 within the base 160. In some further alternatives, both insulation and the feet wraps 169 may be utilized. The liner feet 138 and/or the insulation provides spacing between the base which is in contact with the ground, and the rigid inner liner 130 to limit heat transfer between the two.

Above the base and the feet wraps 169 is the softside exterior material 150, also referred to as a skirt, of the insulated container 100. The softside exterior material 150 may be a pliable material that covers the exterior to provide an aesthetically pleasing appearance. The softside exterior material 150 may for example be sewn, welded, glued, adhered, or otherwise connected to the base 160, along or near a lower edge of the softside exterior material 150. The pliable softside exterior material 150 may be nylon, polyester, PVC, or other material similar material. Additionally, and optionally, the softside exterior material 150 may be coated with some waterproof coating, for example ethylene-vinyl acetate (EVA). In yet another embodiment, separate pliable material may be attachable to the lid 112 and may be nylon, polyester, or other material similar to the softside exterior material 150. It should be understood that while the insulated container 100 may have a bucket shape in some embodiments, the insulated container 100 could be any of various shapes, e.g. cylindrical, square, rectangular, as long as it contains a cavity, as would be appreciated by one of ordinary skill in the art having the benefit of this disclosure.

Likewise, therefore, the softside exterior material 150 may be formed of a shape that corresponds to a covering shape of the rigid inner liner 130. The softside exterior material 150 provides the softside appearance to a rigid inner liner 130 and may be formed of various soft materials in addition or alternative to nylon, polyester, or other fabrics.

The softside exterior material 150 may further comprise a foam insulation 158 to provide a softer exterior feel. For example, in some embodiments, the foam insulation 158 may be a polyurethane foam. The polyurethane foam, or other insulating material, may be a closed cell foam or open cell foam—for example polyurethane open cell, polyethylene closed cell, or EVA may all be utilized, among other insulations. This list is not exhaustive. The foam insulation 158 may be located on the inner surface of the softside exterior material 150 and along the exterior of a rigid inner liner 130. The insulation may be glued, sewn, or otherwise connected to the softside exterior material 150 defining an assembly which is positioned over a rigid inner liner 130.

Positioned above the softside exterior material 150 is a skirt ring 170, which may be formed of rigid material (e.g. plastic, or metal) attached to the upper end 120 of the softside exterior material 150. The skirt ring 170 may be connected to the softside exterior material 150 in a variety of ways. The skirt ring 170 may be located at or near an upper edge of the softside exterior material 150 and for example may be connected in a variety of ways including but not limited to, stitched, fastener, snaps, zipper, glue, sewn, welded, hook and loop, or otherwise connected or adhered, or any combination thereof. Likewise, the base 160 may be connected by same or alternate manner to the lower end 121 of the softside exterior material 150 to the base. Other manners of connection may be used and likewise some connections may occur between the pliable material and the rigid inner liner 130. Together, the base 160, softside exterior material 150, and the skirt ring 170 form an external assembly 190, or skirt assembly.

The skirt ring 170 is hoop-like in shape with an open inner circular shape defined by wall 172. In some embodiments, the skirt ring 170 may be a molded part, such as for example, an injection or blow molded part. For example, the skirt ring 170 may be formed of polypropylene or polyethylene in some embodiments among other non-limiting examples. The skirt ring 170 may be positioned near an upper end 120 of the rigid inner liner 130. The circular shape of the skirt ring 170 allows for positioning of the rigid inner liner 130 downwardly through the skirt ring 170 and within the external assembly 190 so that the skirt ring 170 engages the underside of the collar 134, for example. While the skirt ring 170 is shown as a circular shaped structure in the instant embodiment, such shape should not be considered limiting. As will be shown further herein, other shapes may be utilized depending on the shape of the rigid liner.

The skirt ring 170 may comprise the wall 172 and a plurality of teeth 174 that extend inwardly from the wall 172, for example radially inwardly in some non-limiting embodiments. The teeth 174 may locate the skirt ring 170 relative to the rigid inner liner 130 to properly locate the skirt ring 170 and the entire external assembly 190. The teeth 174 may also inhibit rotation of the external assembly 190 relative to the rigid inner liner 130.

The skirt ring 170 moves upwardly within the collar 134 and is hidden from view within the collar 134. The skirt ring 170 may also comprise one or more ears 176 which extend upwardly from the softside exterior material 150. The ears 176 allow for engagement of the skirt ring 170 with the rigid inner liner 130 for attachment of the components. The ears 176 have apertures 178 that align with collar apertures 135 of the rigid inner liner 130 and are engaged by the handle 140 or by fasteners that connect the body 110 and the handle 140. Thus, the handle 140 holds the softside exterior material 150 up and within the collar 134, so that the external assembly 190 cannot sag and fall down relative to the rigid inner liner 130.

The external assembly 190 is capable of receiving the rigid inner liner 130. The rigid inner liner 130 may be bucket shaped having a bottom 131 and one or more upwardly extending sidewalls 132. The rigid inner liner 130 may include various strengthening ribs 133 which extend vertically along the sidewall 132 of the inner container. In some embodiments, the ribs 133 may extend outwardly or inwardly. For example, in the depicted embodiment, the inwardly extending ribs 133 may form a discontinuous shelf internally which provides a seat for a basket 119. The rigid inner liner 130 may be a molded part for example and may be a single wall or a double walled structure. Where the rigid inner liner 130 is double walled, an inner space between the sidewalls 132 may be air filled, gas filled, or foam insulation filled or in other embodiments may be vacuum evacuated. In some embodiments, the rigid inner liner may be a blow molded, or injection molded, or may be a roto-molded part. The rigid inner liner 130 may be formed of polyethylene, polypropylene, or other materials. This list is not exhaustive as other materials may be utilized.

The bottom 131 of the rigid inner liner 130 may also include liner feet 138 which are molded integrally with the rigid inner liner 130. The rigid inner liner feet 138 may be surrounded by, or received by, the shoes 168 (FIG. 2) previously described to provide an insulating space between the base 160 and the bottom 131 of the rigid inner liner 130. Additionally, this space between the rigid inner liner 130 and the base 160 may include an insulating material, such as foam.

The upper end 120 of the rigid inner liner 130 sidewall 132 may comprise a collar 134 which is open along a bottom of the collar 134, wherein the collar 134 extends circumferentially around the sidewall 132. The space along the bottom of the collar 134 allows for insertion or receipt of the skirt ring 170. The skirt ring 170 and the collar 134 may comprise friction fit engagement or may include fasteners, such as snap fit locks, catches, latches, or other locking and/or locating features, so that the skirt ring 170 fits within and is retained within the collar 134. The collar 134 may also comprise apertures 135 which align with ear apertures 178 of the skirt ring 170. The ear apertures 178 being aligned with collar apertures 135 allows insertion of portions of a handle 140 through both the collar 134 and the softside exterior material 150. In this way, the handle 140 also retains the softside exterior material 150 within the collar 134 due to its extending through the apertures 135, 178 of both.

The lid 112 is shown exploded from the top of the inner container. The lid 112 may be formed of a rigid, or semi-rigid material. For example, the lid 112 may be formed of a high density polyethylene (HDPE) which may optionally include a polyurethane foam on an inner surface or an outer surface of the lid 112. For example, a polyurethane foam which may be seated on the open end of the rigid inner liner 130. In other embodiments, the lid 112 may be formed of a more rigid material with insulating properties or material to which an insulation may be added. The lid 112, in some embodiments, may be circular in shape and comprise an overhanging flange portion 115 so that the outer diameter of the lid 112 is approximately the same size as the rigid inner liner 130 plus the pliable material and so that a portion of the lid 112 fits downwardly within the rigid inner liner 130, in the form of a plug. The circular shape may vary however depending on the shape of the remainder of the rigid inner liner 130.

The lid 112 may comprise one or more locating features 113 on the overhanging flange portion 115 which provides the lid 112 proper clocking or orientation relative to the base of the insulated container 100. The locating features 113 of the lid overhanging flange portion 115 engage with corresponding features on the rigid inner liner 130. For example, the lid 112 may have one or more locating features 113, such as notches, which engage one or more male protuberances 137 along an upper edge the rigid inner liner 130. However the male and female parts may be reversed to properly locate the lid 112 relative to the body 110 of the insulated container 100. The male and female parts are facing one another along an upper edge of the rigid inner liner 130 and a lower surface of the lid 112. This way the features can engage when aligned.

Additionally, the lid 112 comprises a lid lug 117 which may be engaged by the handle 140. The lid lug 117 is also oriented relative to a handle 140 when the lid 112 is properly aligned relative to the body 110 of the insulated container 100 by the locating features 113 and male protuberances 137. In some embodiments, the lid lug 117 may be engaged by the handle in one or more positions. For example, in some embodiments the handle 140 engages the lid 112 in two positions. In this way, the lid 112 may be locked or retained on the base of the insulated container 100 when the handle 140 is in a position to carry the insulated container 100. Further, the handle 140 may be rotated downward in one direction to also retain the lid 112 in position. When rotated in the opposite direction, the handle 140 may disengage the lid 112 so that the lid 112 may be removed.

Also exploded in the figure is the handle 140. The handle 140 may be of various shapes and is shown as a generally U-shaped structure with L-shaped ends 146. The L-shaped ends 146 may be located opposite one another for connection to the body 110 of the insulated container 100. The L-shaped ends 146 may comprise locking protrusions 147, 148 that engage the lid lugs 117. The protrusions 147, 148 also comprise portions which locate the handle 140 relative to the lid lugs 117 to provide some positive locking feedback.

The handle 140 may also have a pivot connector and/or fastener 149 that extends through the handle 140, the collar 134 and through the ear aperture of the softside exterior material 150. The pivot connector 149 may be located at each L-shaped end 146 defining two opposite pivot locations for the handle 140. The pivot connectors 149 have a generally cylindrical shape that pass through the softside exterior material 150 and/or the collar 134 so that the handle 140 may pivot. Additionally, the pivot connector 149 passes through the apertures 135, 178 to retain the skirt assembly 190 in position relative to the rigid inner liner 130. The pivot connector 149 may be a separate structure or may be integrally formed on the collar 134 or the handle 140. In the depicted embodiment, for example, a fastener 179 such as a snap rivet may extend through the handle 140 at ends and through the hollow cylindrical structure, and further extend through the apertures 178, 135. Thus in some embodiments, the pivot connector 149 and the fastener 179 may be distinct parts.

Each L-shaped end 146 of the handle 140 defines two locking legs. The locking legs function to retain the lid 112 on the base 160 of the insulated container 100 or function to release the lid 112 from the base 160 for access to the interior of the insulated container 100. The protrusions 147, 148 extend from an inner surface of the locking legs and in preselected positions of the handle 140 engage an upper surface or edge of the lid lugs 117. In the depicted embodiment, each leg of each L-shaped end 146 comprises the respective protrusions 147, 148.

The insulated container 100 may also have one or more accessories 180 that mount to the insulated container 100. One such accessory 180 is shown in the figure. In some embodiments, a fishing rod holder 182 may be connected to the insulated container 100 in order to hold a fishing rod. The insulated container 100 may include one or more accessory retainers 139. In the example shown, the collar 134 may comprise a female accessory retainer 139 which receives a male part on the accessory 180. In other embodiments, the male and female structures may be reversed. In still further embodiments, alternate types of fastening structures or methods may be used that allow for removal and interchangeability of different accessories 180 relative to the insulated container 100. Other accessories may be utilized such as a beverage holder, can or bottle for example, among others.

Figure 3:
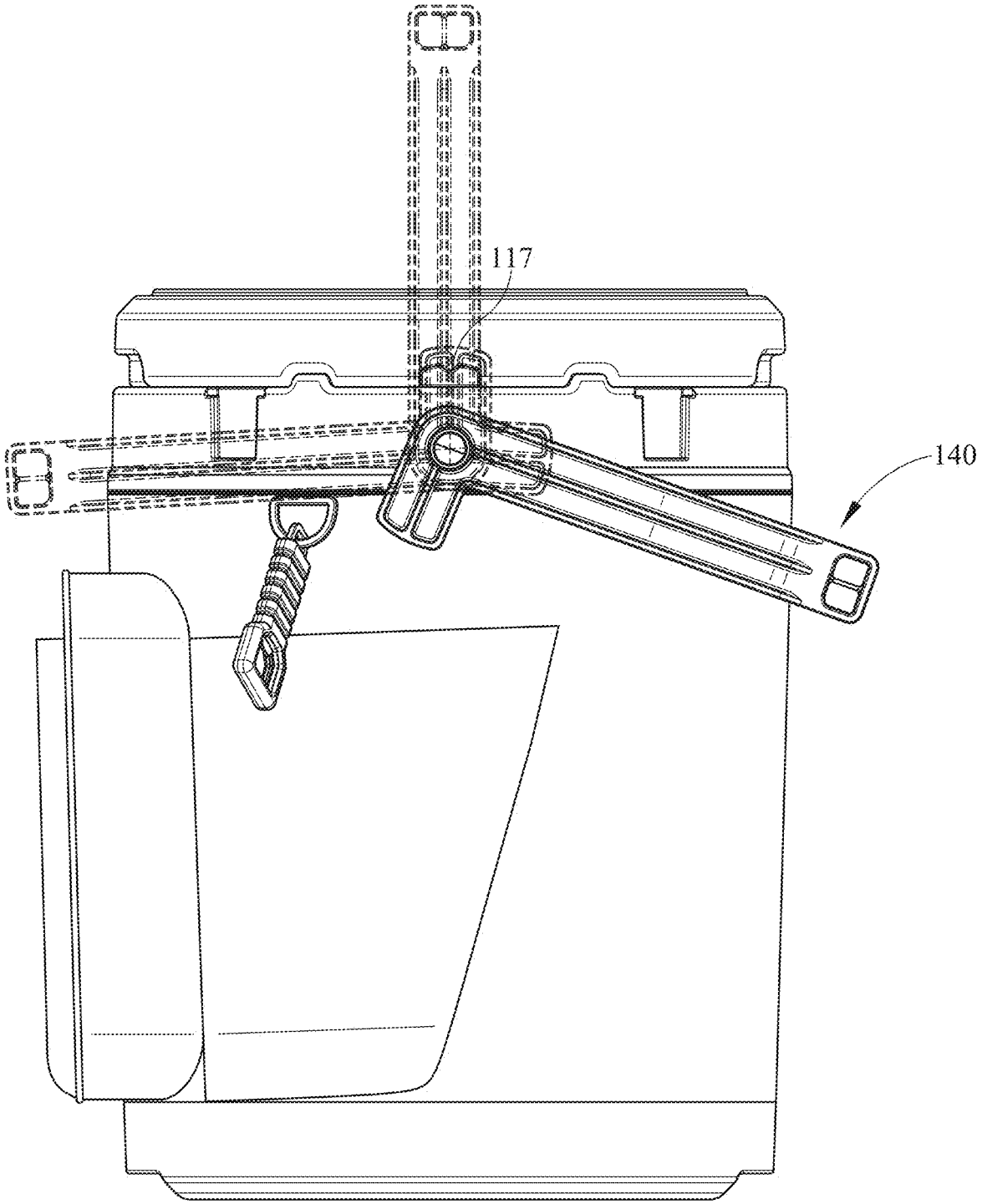
FIG. 3 is a side view of the insulated container.

Referring now to FIG. 3, a side view of the insulated container 100 is shown. The side view depicts the handle 140 in one of the preselected positions. As shown, the handle 140 is rotated to a position wherein the lid lug 117 is exposed. In this handle position the lid 112 may be removed, as it is not engaged by the handle 140.

Also shown in FIG. 3, the handle 140 is shown rotated to a second position, a substantially vertical position depicted in broken line. The handle 140 has the protrusions 147, 148 on the rear side of the handle 140, not seen in this view. In this second handle position, the protrusion 148 is disposed above the lid lug 117, and this provides that the protrusions 148 engage the lid lug 117, precluding removal of the lid 112. In other words, when the handle 140 is in a carrying position, and the lid 112 is blocked from being removed, or inadvertently falling off for example.

Still referring to FIG. 3, the handle 140 is also shown rotated further to a third position, which is generally opposite the position shown in solid line. In this view, the handle 140 is rotated about 220 degrees. The amount of rotation may vary depending on the angle of the L-shaped ends 146 of the handle 140. In this third handle position, the end of the L-shaped end 146 is disposed above the lid lug 117 so that the protrusion 147 is positioned above the lid lug 117. As a result, although the handle 140 is rotated generally out of the way of the lid 112, the lid 112 cannot be removed. Thus, in two positions, the third position and the second, upright position, the handle 140 precludes removal of the lid 112. In the first position, shown in solid lines, the handle 140 does not block removal so that the lid 112 may be removed to access contents of the insulated container 100.

Figure 4:
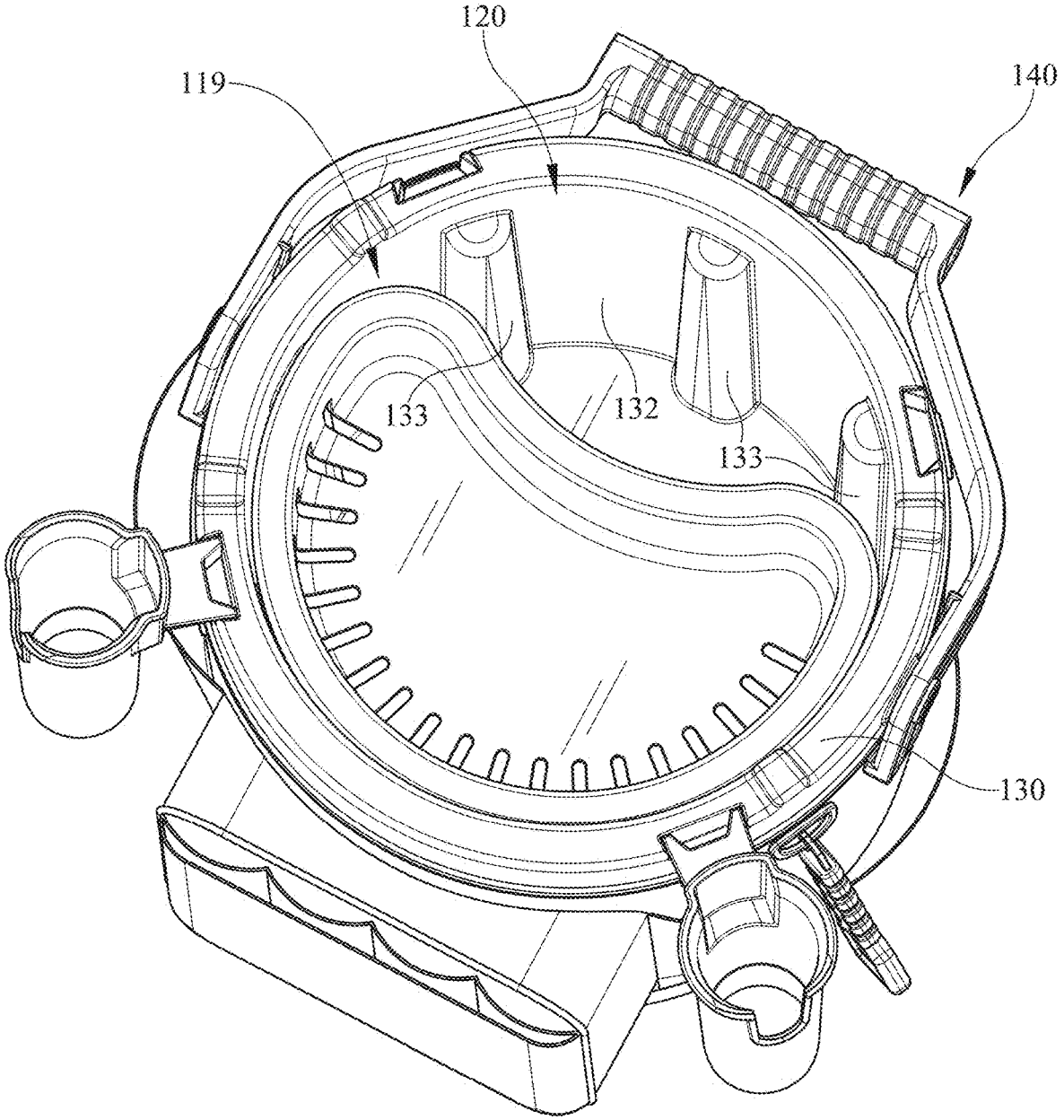
FIG. 4 is an upper perspective view of the insulated container.

Referring now to FIG. 4, an upper perspective view of the insulated container 100 is shown. The upper perspective view depicts the rigid inner liner 130 and shows a plurality of ribs 133 extending inwardly along the inner surface thereof. The upper edges of the ribs 133 define a shelf that is spaced below the upper edge of the opening of the rigid inner liner 130. The spacing between the upper end 120 of the rigid inner liner 130 and the upper edge of the shelf allows for positioning of a basket 119 within the rigid inner liner 130. When positioned in the rigid inner liner 130, the basket 119 may be disposed far enough beneath the upper edge of the rigid inner liner 130 to allow for positioning of the lid 112 within rigid inner liner 130.

The basket 119 may be shaped to allow access to positions below the upper edge. In the depicted example, the basket 119 may be kidney shaped although other shapes may be utilized. The shape allows a user to move the basket 119 around within the rigid inner liner 130 along the upper edges of the ribs 133 and likewise the shape allows the user to access contents below the basket 119 by reaching through the space between the basket 119 and sidewall 132 of the rigid inner liner 130, or alternately rotating the basket 119 relative to the rigid inner liner 130.

The basket 119 provides elevated positioning of certain foods that perhaps a user may not want to mix with ice that melts over time. For example, a user may want to store a sandwich or other food item that they want to prevent from becoming soggy. The basket 119 provides an elevated location for storing of the food product.

Figure 5:
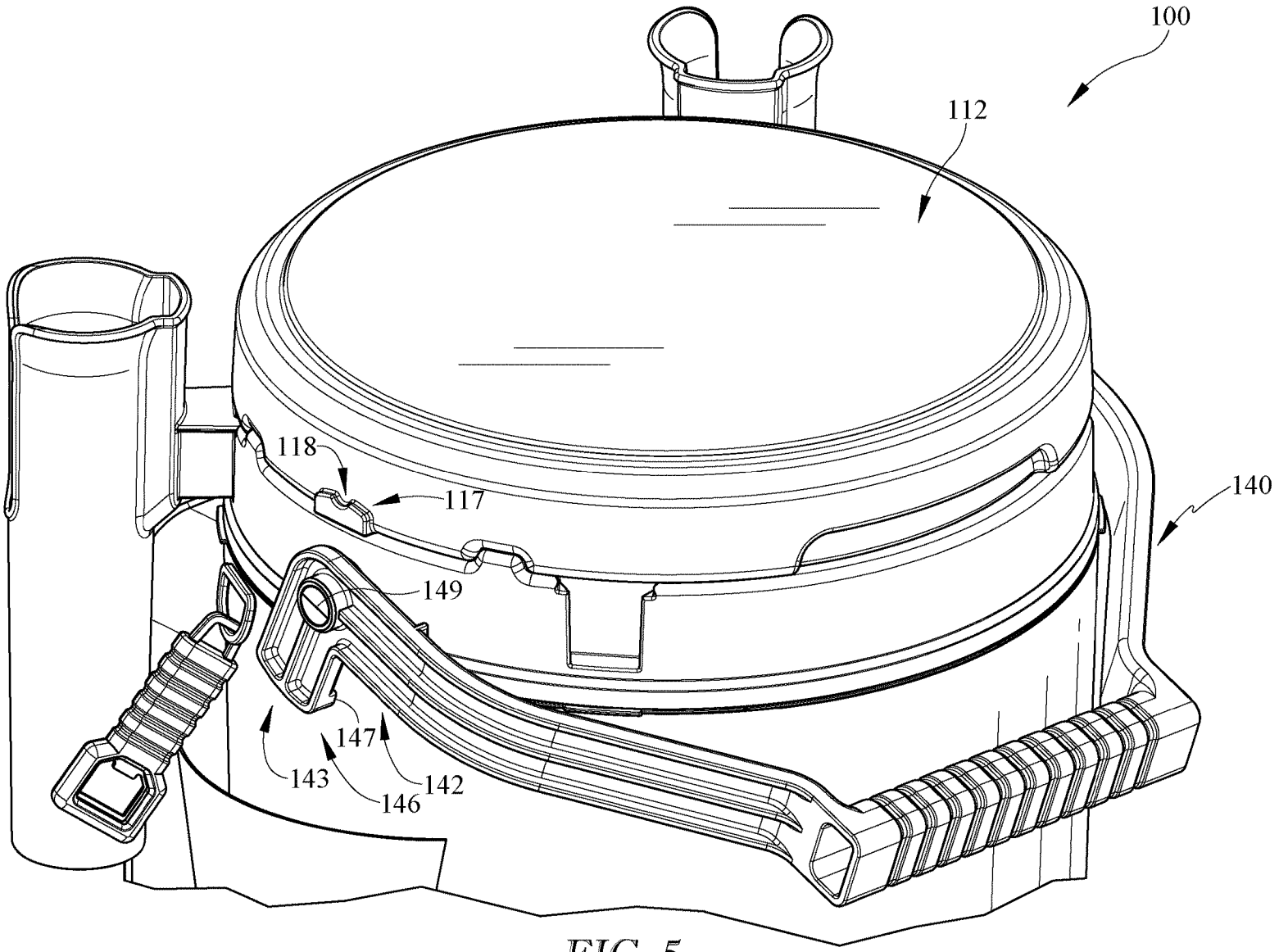
FIG. 5 is a perspective detail view of the handle and lid.

Referring now to FIG. 5, a detailed perspective view of the handle 140 and lid 112 is shown. The lid 112 comprises a lid lug 117 that is positioned above the collar aperture 135 and the ear aperture 178 of the skirt ring 170. The L-shaped ends 146 each have a first leg 142 and a second leg 143. Each leg 142, 143 of each L-shaped end 146 of the handle 140 has one of the protrusions 147, 148 (FIG. 2). Each protrusions 147, 148 (FIG. 2) corresponds to a locking position of the handle 140. As previously described, on opposite sides of the lid 112, one protrusion 148 engages the lid lug 117 when the handle 140 is upright for carrying. The second protrusion 147 engages the lid lug 117 when the handle 140 is rotated downwardly. In either of these positions the lid 112 is locked by the handle 140 on the insulated container 100. In a third handle 140 position, opposite the second position, the protrusions 147, 148 are clear of the lid lug 117, so that the lid 112 may be removed.

The lid lug 117 may comprise a depression or recess 118 to receive a corresponding portion of the protrusions 147, 148. The depression or recess 118 and the handle 140 may provide a positive feedback for a user that the handle is engaging the lid lug 117 so that the lid cannot be removed.

Figure 6:
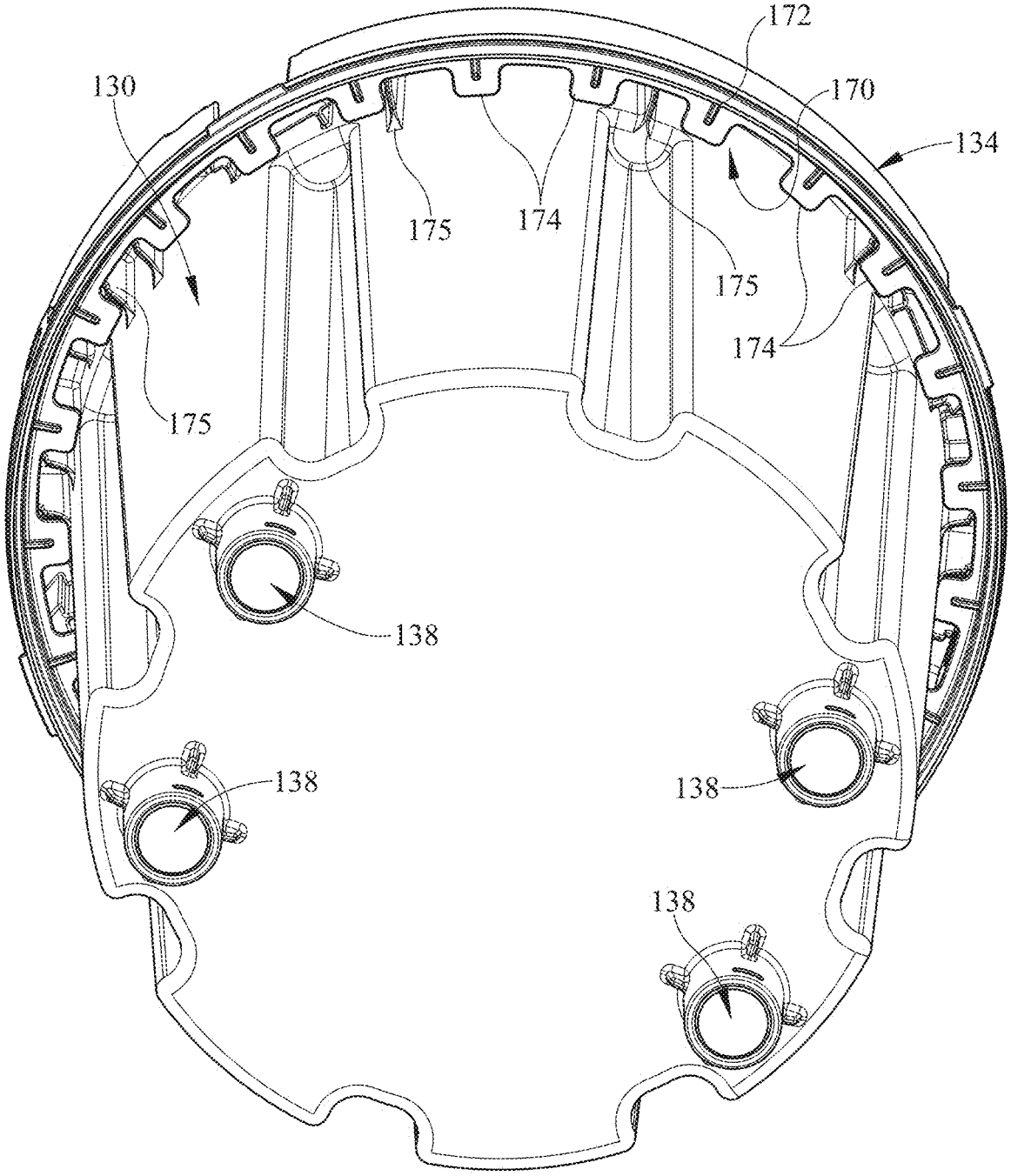
FIG. 6 is a bottom view of the collar and space thereof is shown with an adjacent upper view of the skirt.

Referring now to FIG. 6, a bottom view of the collar 134 and space thereof is shown with an adjacent upper view of the softside exterior material 150. The collar 134 is disposed along the upper portion of the rigid inner liner 130. The view from beneath the collar 134 shows a plurality of spaced apart ribs 175 on the inside surface of the collar 134. The ribs 175 are spaced apart in a spacing related to the teeth 174. The skirt ring 170 comprises the plurality of teeth 174 extending inwardly from the wall 172 and the teeth 174 are spaced apart so that the ribs 175 fit between the teeth 174.

The ribs 175 prevent rotation of the teeth 174 and therefore the skirt ring 170 relative to the rigid inner liner. Accordingly, the teeth 174 also aid in proper alignment of the skirt ring 170 relative to the collar 134. The ears 176 of the softside exterior material 150 also aid in alignment relative to the collar 134 during installation. Both the teeth 174 and the ears 176 provide alignment and anti-clocking functions for the softside exterior material 150 relative to the collar 134.

Figure 7:
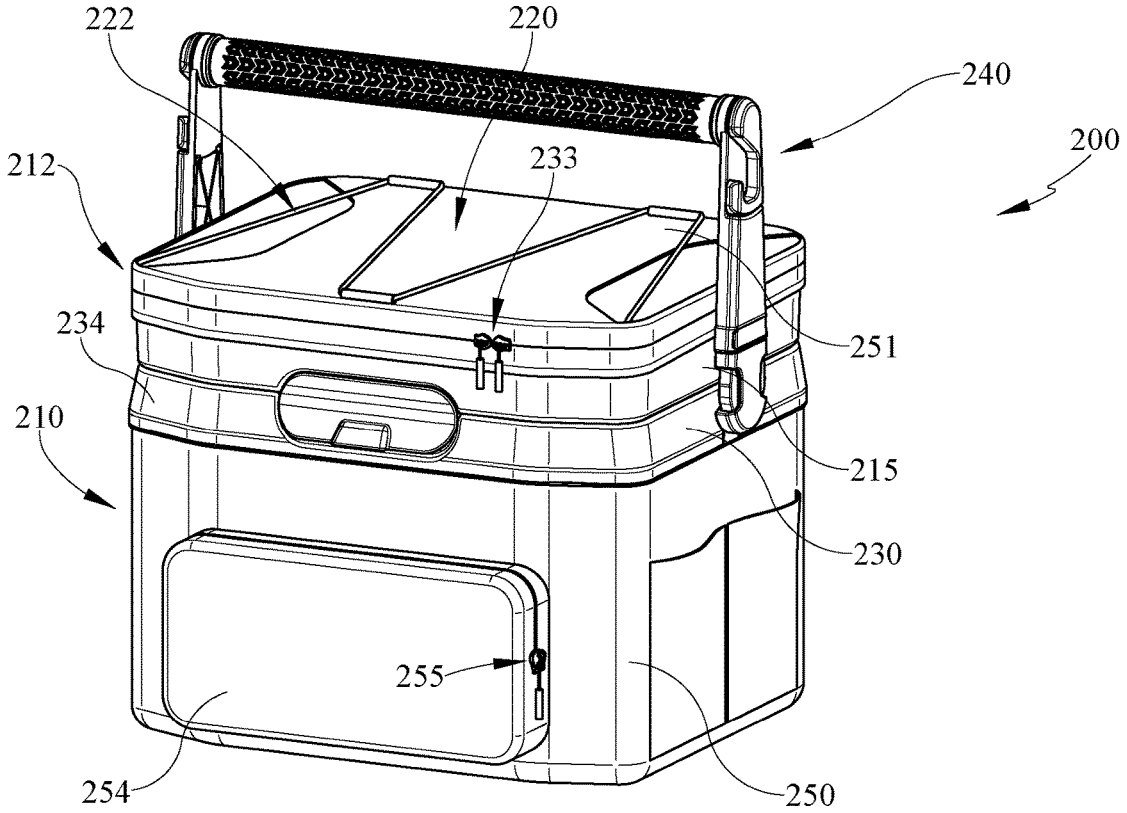
FIG. 7 a perspective view of an alternative insulated container.

Referring now to FIG. 7, a perspective view of an alternative insulated container 200 is depicted. In this embodiment, the insulated container 200 is in the form of a cooler. The insulated container 200 has an exterior which may be formed of a soft material, but an inner liner that is rigid, within the soft material exterior. Thus, the insulated container 200 has the appearance of a softside or soft shell cooler, but is more rigid than a typical softside or soft shell container. The insulated container 200 comprises a body 210 and a lid 212. The lid 212 is depicted as hingedly connected to the body 210 but may also be removably or reversibly connected, in some embodiments.

The body 210 of the insulated container 200 may have a softside exterior material 250. Likewise, the lid 212 may comprise an exterior soft shell material or lid soft side exterior material 251. In the depicted embodiment, the lid 212 may also comprise a rigid lid portion 215 and the body 210 may comprise a rigid portion or inner liner 230 which abut one another when the lid 212 is in the closed position. The softside exterior materials 250, 251 may be connected to the rigid lid portion 215 and rigid inner liner 230 in order to provide an aesthetically pleasing appearance, while the rigid lid portion 215 and rigid inner liner 230 provide improved strength and insulating function.

A bail handle 240 is shown pivotally connected to the body 210 and allows for carrying of the insulated container 200. The pivot function allows for movement of the handle 240 out of the way, so that the lid 212 may be pivoted open. The bail handle 240 may also be removed and/or replaced with a shoulder strap 340 (FIG. 12) for an alternative manner of carrying. As described further herein, the bail handle 240 or strap 340 both may be used to retain the softside exterior material 250 on the rigid inner liner 230.

The lid 212 is shown in a closed configuration, but may comprise an upper compartment 220 within the lid soft shell material 251 for storage of materials, for example of dry goods. The upper compartment 220 is located within the rigid lid portion 215 of the lid 212, and within the lid soft shell material 251. The upper compartment or storage area 220 may be opened by a closure 233, for example, and without limitation, a zipper assembly. Additionally, the lid 212 may be opened by pivoting the rigid lid portion 215 of the lid 212 relative to the rigid inner liner 230 of the body 210. This provides for access into the storage area 263 (FIG. 11) within the body 210, for example where ice, liquids, and/or food may be located. On the upper surface of the lid soft shell material 251 a bungee or cord 222 may be provided to retain items on the top surface thereof. Alternatively, other structures may be used on the upper surface of the lid soft shell material 251.

Further, one or more pockets 254 may also be disposed on the softside exterior material 250 of the body 210 and may comprise closures 255, such as a zipper for example and without limitation, to open and close access to such and preclude access to the interior of the pocket 254 where goods may be stored. The pocket 254 interior may also stay dry since any wet or cold products may be retained within the interior storage area 263 of the rigid inner liner 230. The pocket may or may not be insulated.

Beneath the softside exterior material 250 of the body 210 is the rigid inner liner 230. The rigid inner liner 230 may be formed of a rigid material such as polyethylene, polypropylene, or other insulating material, without limitation. The softside exterior material 250 covers the rigid inner liner 230 to provide a more desirable exterior for the insulated container 200.

Figure 8:
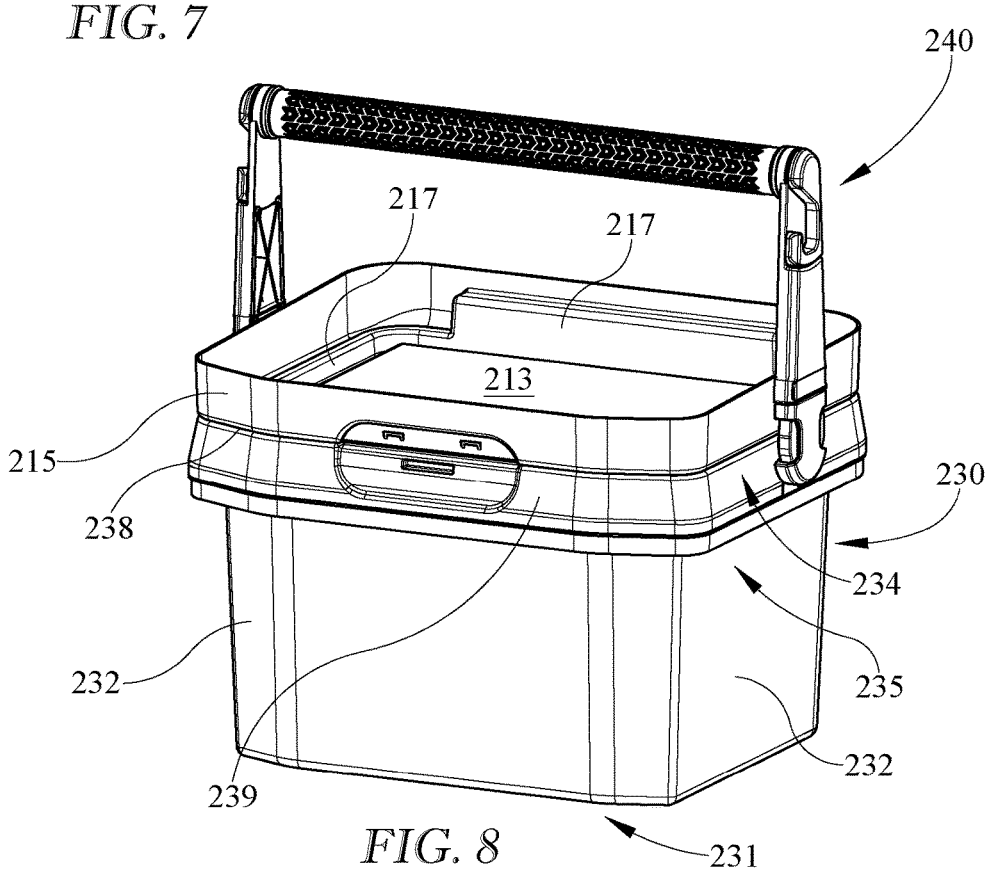
FIG. 8 a perspective view of the rigid inner liner and rigid portion of the lid.
Figure 11:
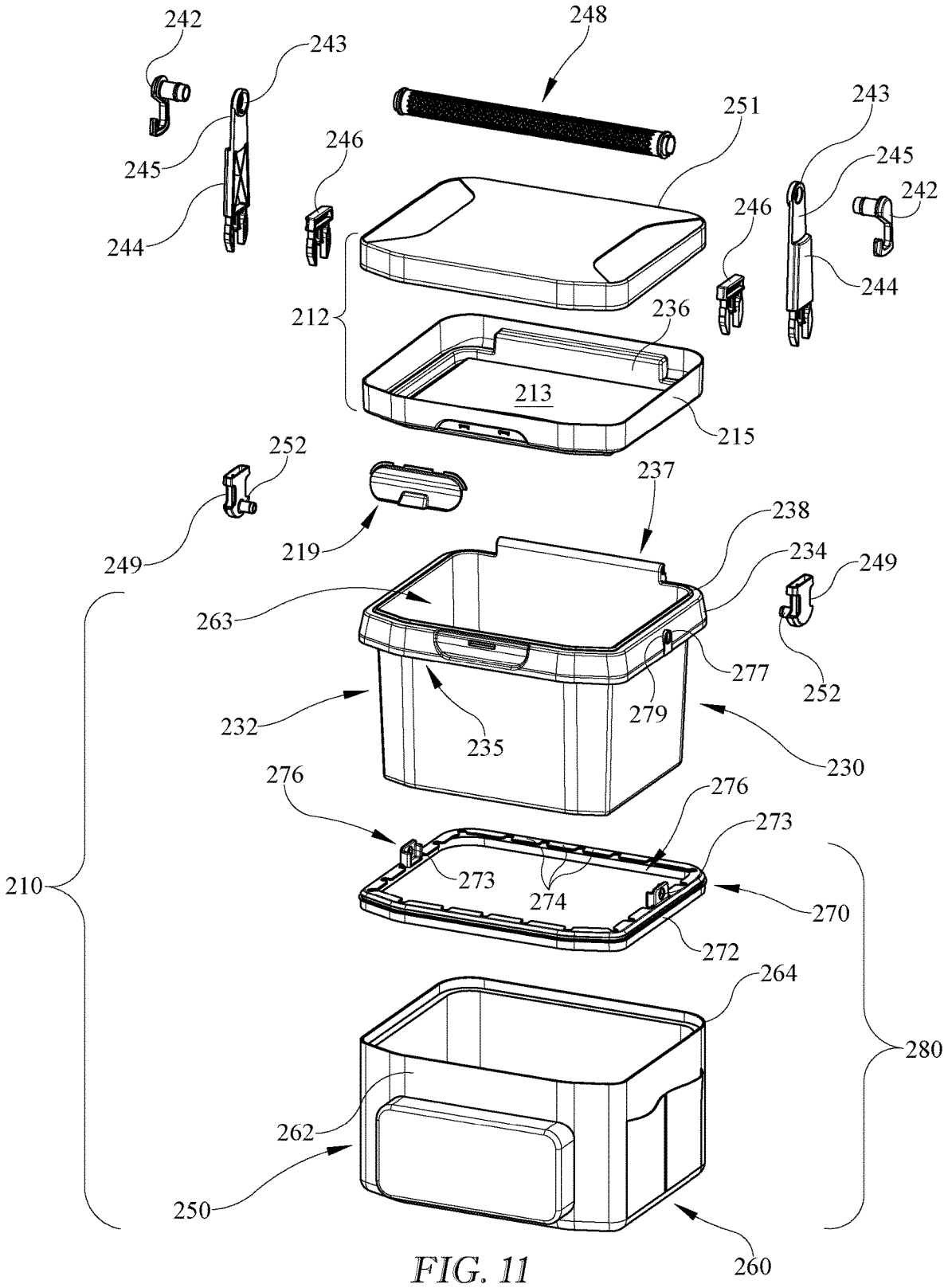
FIG. 11 is an exploded perspective view of the insulated container of FIG. 7; and, FIG. 12 is a perspective view of the insulated container of FIG. 7 with the handle removed and a shoulder strap shown attached.

As provided in the previous embodiments, the body 210 may comprise a collar 234 which defines a space 235 (FIG. 8). More specifically, the upper portion of the rigid inner liner 230 comprises the collar 234 and the space 235 is generally defined where the collar 234 extends from the remainder of the rigid inner liner 230. The space 235 may receive a skirt ring 270 (FIG. 11) which connects to the exterior softside material 250 together which define a skirt assembly 280 (FIG. 11). Accordingly, the skirt assembly 280 is retained within the space 235 formed by the collar 234. In the depicted embodiment, collar 234 extends around the periphery of the rigid inner liner 230.

A handle 240 extends from the body 210 and is pivotally connected. The buckles 249 retain the skirt assembly 280 in position within the collar 234. The handle 240 and strap 340 (FIG. 12) may both be connected to the buckles 249 allowing for interchangability while functioning to retain the softside exterior material 250 in position relative to the rigid inner liner 230.

Referring now to FIG. 8, the rigid inner liner 230 and rigid lid portion 215 of the lid 212 are shown in perspective view. The softside exterior materials 250, 251 of the body 210 and the lid 212 are removed. The rigid inner liner 230 is shown comprising a base 231 and one or more walls 232 extending therefrom. The walls 232 may be vertical or maybe angled. Additionally, the walls 232 may comprise a single wall structure or may be double walled to provide a space for air, vacuum, or insulating material therebetween.

At the upper end of the one or more walls 232 is the collar 234. The collar 234 has an outwardly extending portion that defines an upper lip 238 of the body 210 which engages with the lid 212. The collar 234 also comprises a downward portion 239 from the upper lip 238 creating the space, generally between the downwardly extending portion and the one or more walls 232. The collar 234 is shown extending about the upper lip 238 of the body 210.

The body 210 also comprises pivot mounts along opposed sides. In some embodiments, the pivot mounts 279 (FIG. 11) are located on the collar 234. The pivot mounts 279 may each comprise a hole 277. The handle 240 may be connected to the buckles 249 which are connected to pivot mounts 279 to allow pivoting movement of the handle 240 relative to the body 210.

Additionally, the lid 212 is shown with the lid soft shell material 251 (FIG. 7) removed. The rigid lid portion 215 also comprises one or more lid walls 217 that extend upwardly from a lid floor 213. The lid 212 comprises the rigid lid portion 215 that defines the lid floor 213 to close the storage area within rigid inner liner 230. The lid floor 213 also defines a floor of the soft shell portion upper compartment 220 of the lid 212. Thus, when the upper compartment 220 (FIG. 7) of the lid soft shell material 251 is opened, the contents within the rigid inner liner 230 are not exposed. Instead, to access those contents within the rigid inner liner 230, the lid 212 is rotated upwardly relative to the rigid inner liner 230.

Figure 9:
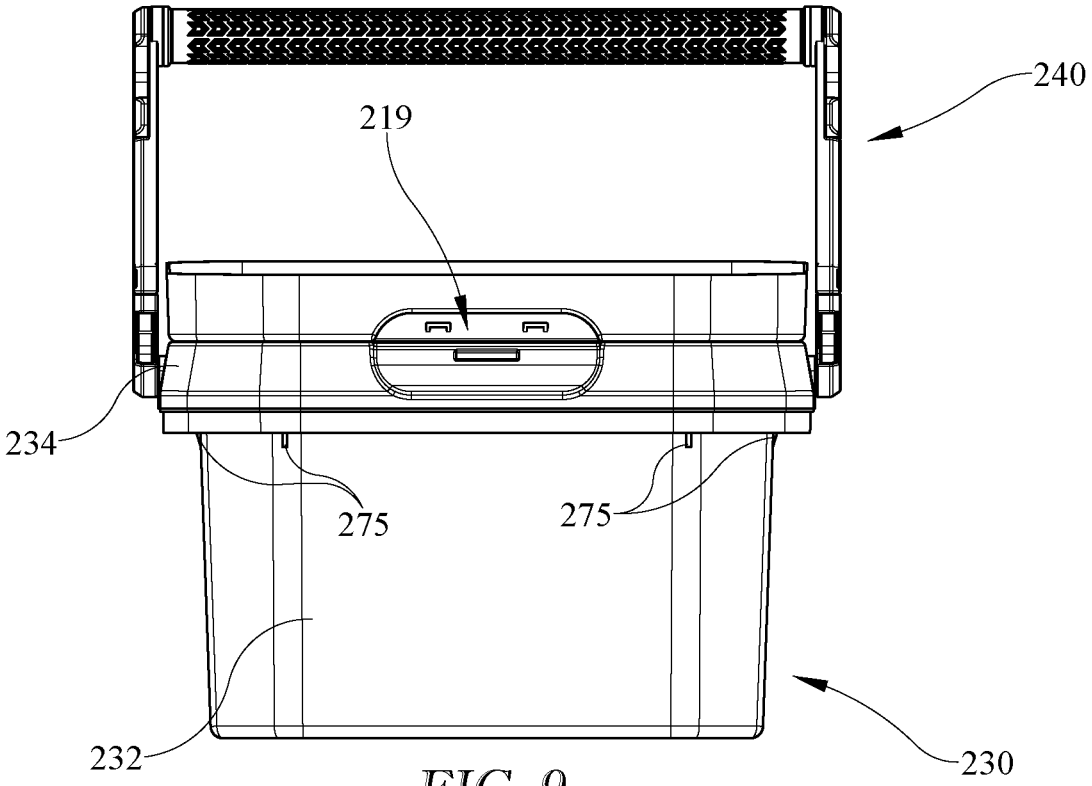
FIG. 9 is a front and view of the rigid liner.
Figure 10:
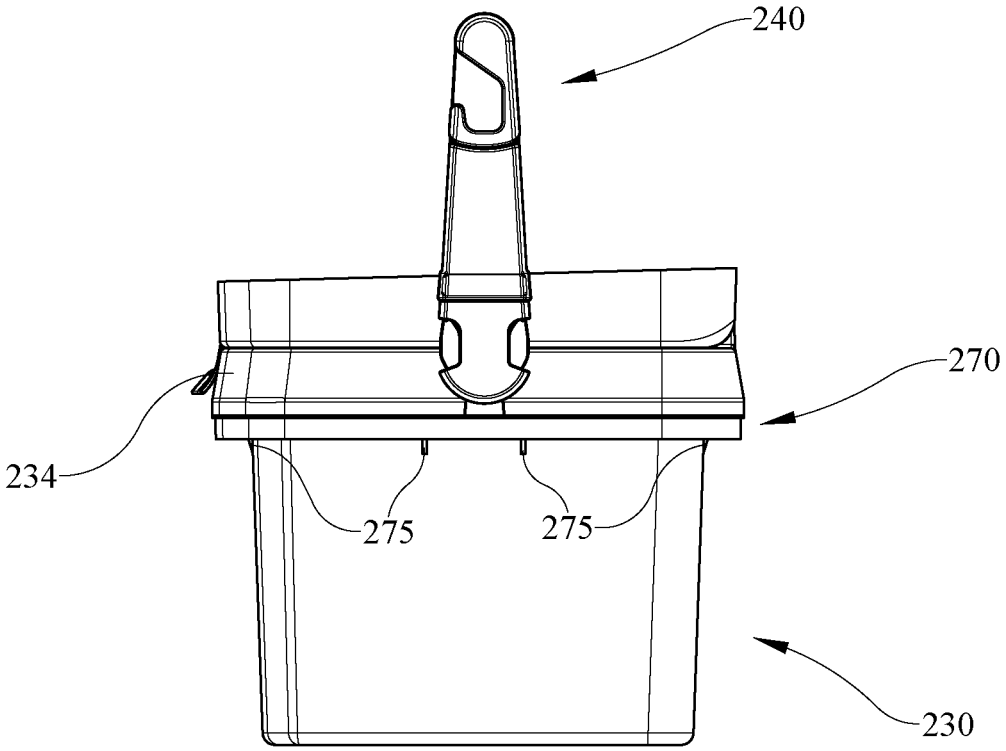
FIG. 10 is a side and view of the rigid liner.

With additional reference to FIGS. 9 and 10, front and side views of the rigid inner liner 230 are depicted. The collar 234 is shown at the top of the one or more walls 232 of the rigid inner liner 230. Also shown are a plurality of ribs 275 located within the space 235 defined by the collar 234. The ribs 275 provide additional strength and rigidity to the upper end of the one or more walls 232, and the collar 234. As will be described further, the ribs 275 also provide an alignment function.

One of the rigid lid portion 215 or rigid inner liner 230 may also comprise a latch 219 to open and close the lid 212. The latch 219 may comprise a rigid structure, magnetic, hook and loop, button, or other such devices in order to retain the lid 212 in a closed configuration relative to the rigid inner liner 230. The other of the rigid lid portion 215 or rigid inner liner 230 may also comprise a catch for example, and without limitation, which is engaged by the latch 219 to retain the lid 212 in the closed position. The catch may comprise various structures depending on what defines the latch 219.

Referring now to FIG. 11, is an exploded perspective view of the insulated container 200. Starting at the bottom, the softside exterior material 250 is depicted. The softside exterior material 250 may be formed of a pliable material such as nylon, polyester, PVC, or other material similar material. Additionally, and optionally, the softside exterior material 250 may be coated with some waterproof coating, for example EVA. The softside exterior material 250 may further comprise a foam insulation to provide a softer exterior feel. For example, in some embodiments, the foam insulation may be a polyurethane foam. The polyurethane foam, or other insulating material, may be a closed cell foam or open cell foam—for example polyurethane open cell, polyethylene closed cell, or EVA may all be utilized, among other insulations. This list is not exhaustive. The foam insulation may be located on the inner surface of the softside exterior material 250 and along the exterior of the rigid inner liner 230. Alternatively, the foam insulation may be located between two layers of fabric defining the softside exterior material 250. The foam insulation may be glued, sewn, or otherwise connected to the interior side of the softside exterior material 250 defining an assembly which is positioned over the rigid inner liner 230.

The softside exterior material 250 may defined by a soft shell base 260 and one or more soft shell walls 262. The upper end of the one or more soft shell walls 262 may define an upper opening 264 which receives the rigid inner liner 230.

Above the softside exterior material 250 is a skirt ring 270. The skirt ring 270 and the softside exterior material 250 define a skirt assembly 280. The skirt ring 270 is a rigid structure (e.g. plastic, or metal), for example molded plastic material such as polypropylene or polyethylene, which may be blow molded or injection molded, and which matches the rigid portion of the shape of the collar 234. The skirt ring 270 comprises a wall 272 which generally is rectangular in shape, corresponding to the insulated container 200. Extending inwardly from the wall 272, the skirt ring 270 may comprise a plurality of teeth 274 which may locate the skirt ring 270 within the space 235 of the collar 234. Each pair of teeth 274 define an opening therebetween, and which receives a rib 275 (FIGS. 9, 10). The upper edge of the softside exterior material 250 may be connected to the skirt ring 270, for example by fastener, adhesive, welding or other connection methods. This is not limiting as other manners of connection may be utilized. Once the softside exterior material 250 and skirt ring 270 are joined, defining the skirt assembly 280, the skirt assembly 280 may be positioned within the collar 234 of the rigid inner liner 230.

The skirt ring 270 may further comprise ears serving as retention structures wherein holes 273 are formed. The holes 273 cooperate with holes 277 in the collar 234 and the pins 252, in order to retain the skirt assembly 280 in position. More specifically, the pins 252 extend through the holes 277, 273 and retain the skirt assembly 280 in position on the rigid inner liner 230.

Disposed above the skirt ring 270 is the rigid inner liner 230. The collar 234 comprises the space 235 wherein the skirt ring 270 may be inserted and retained. Also shown in this view at lateral ends of the collar 234 are holes 277, which align with holes 273 on the skirt ring retention structures 276. The holes 277 of the collar 234 receive portions of the pivot connection, for example each buckle 249.

Figure 12:
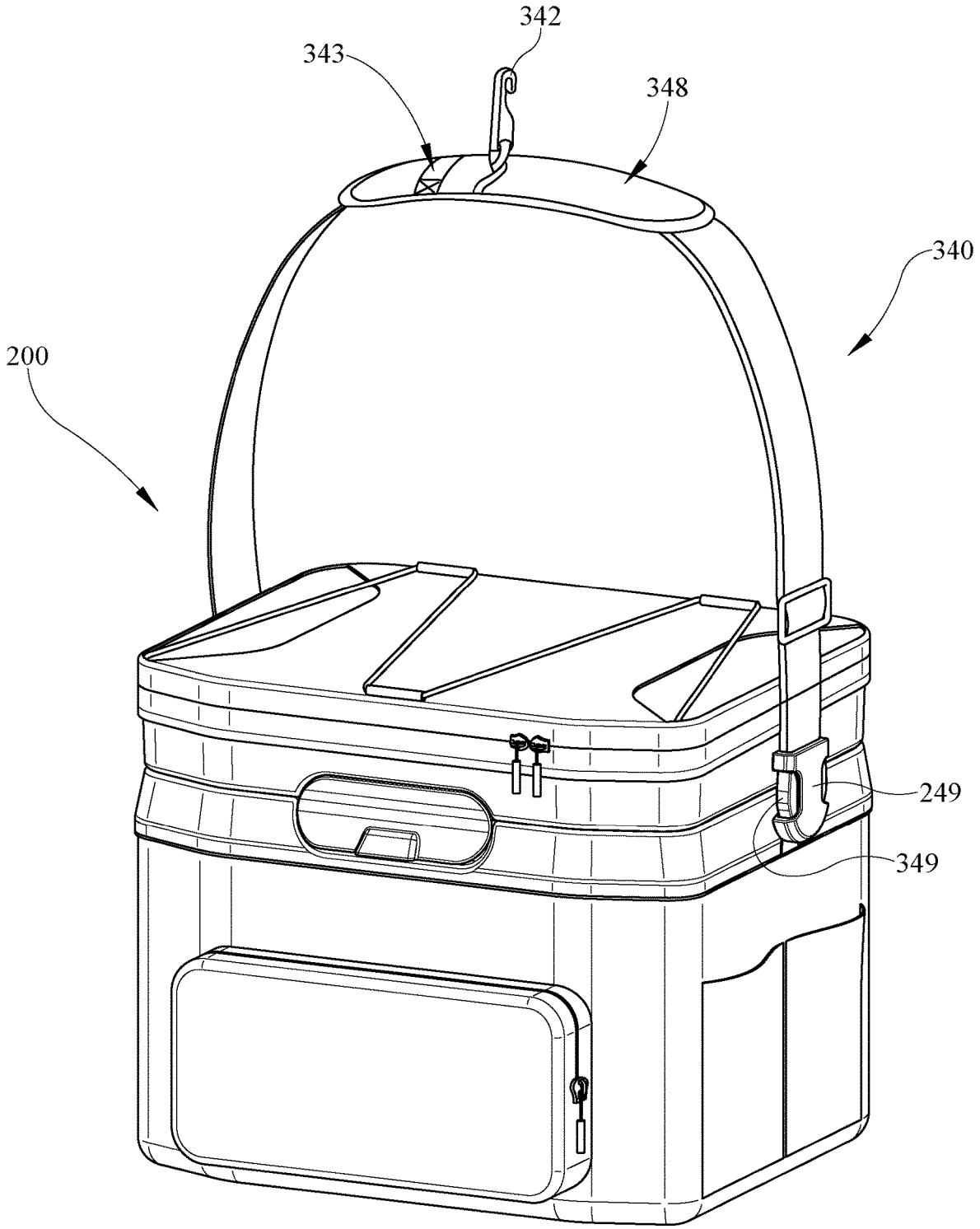

Adjacent to the collar 234 are buckles 249 which define a pivot connection that may be connected to the handle 240 or to a shoulder strap 340 (FIG. 12). The buckles 249 each comprise the pin 252 that extends through the hole 277 in the collar 234 and the hole 273 in the skirt ring retention structures 276. Thus, the skirt assembly 280 is retained by the buckles 249 when the insulated container 200 is assembled.

Above the rigid inner liner 230, is the rigid lid portion 215. The rigid lid portion 215 has a floor 213 and the one or more lid walls 217. As described before, the one or more walls 217 define a location where the lid soft shell material 251 may be used for additional storage and separate of the compartment within the rigid inner liner 230.

Also shown on each of the rigid lid 212 and rigid inner liner 230, are the hinge portions 236, 237. The hinge portions 236, 237 cooperate to provide the pivoting motion between the rigid inner liner 230 and the rigid lid portion 215.

Above the buckles 249 are arms 244. The arms 244 may comprise notches or holes 243 wherein hooks 242 may be seated on an outwardly facing surface of the arms 244. The hooks 242 may be rotated upwardly from the position shown so that they may engage a fence or other structure to hang insulated container 200 therefrom. The hooks 242 are disposed on the exterior side 245 of the arms 244 but in the alternative may be placed between the arms 244 and a handlebar 248. The handlebar 248 extends between the upper ends of the arms 244. The lower end of the arms 244 are provided with male buckle portions 246 that engage the buckles 249, which are pivotally connected to the collar 234.

Referring now to FIG. 12, a perspective view of the insulated container 200. In this embodiment, the handle 240 (FIG. 7) is removed and the shoulder strap 340 is shown connected to the insulated container 200. The shoulder strap 340 comprises buckle portions 349 at ends, so that the shoulder strap 340 may be connected to the buckles 249 on the insulated container 200, so that the shoulder strap 340 may be used.

The shoulder strap 340 may also comprises a shoulder pad 348 made of plastic, rubber, fabric material, or other material(s) or combinations. The shoulder strap 340 may also comprise a hook 342 that is fastened to the shoulder pad 348. Specifically, the hook 342 may be positioned on the shoulder pad 348, for example in a pocket 343 of the shoulder pad 348. The hook 342 also allows the shoulder strap 340 embodiment to hook to a fence or other structure. When not in use, the hook 342 may be positioned in the pocket 343.

While several inventive embodiments have been described and illustrated herein, those of ordinary skill in the art will readily envision a variety of other means and/or structures for performing the function and/or obtaining the results and/or one or more of the advantages described herein, and each of such variations and/or modifications is deemed to be within the scope of the invent of embodiments described herein. More generally, those skilled in the art will readily appreciate that all parameters, dimensions, materials, and configurations described herein are meant to be exemplary and that the actual parameters, dimensions, materials, and/or configurations will depend upon the specific application or applications for which the inventive teachings is/are used. Those skilled in the art will recognize, or be able to ascertain using no more than routine experimentation, many equivalents to the specific inventive embodiments described herein. It is, therefore, to be understood that the foregoing embodiments are presented by way of example only and that, within the scope of the appended claims and equivalents thereto, inventive embodiments may be practiced otherwise than as specifically described and claimed. Inventive embodiments of the present disclosure are directed to each individual feature, system, article, material, kit, and/or method described herein. In addition, any combination of two or more such features, systems, articles, materials, kits, and/or methods, if such features, systems, articles, materials, kits, and/or methods are not mutually inconsistent, is included within the inventive scope of the present disclosure.

All definitions, as defined and used herein, should be understood to control over dictionary definitions, definitions in documents incorporated by reference, and/or ordinary meanings of the defined terms. The indefinite articles "a" and "an," as used herein in the specification and in the claims, unless clearly indicated to the contrary, should be understood to mean "at least one." The phrase "and/or," as used herein in the specification and in the claims, should be understood to mean "either or both" of the elements so conjoined, i.e., elements that are conjunctively present in some cases and disjunctively present in other cases.

Multiple elements listed with "and/or" should be construed in the same fashion, i.e., "one or more" of the elements so conjoined. Other elements may optionally be present other than the elements specifically identified by the "and/or" clause, whether related or unrelated to those elements specifically identified. Thus, as a non-limiting example, a reference to "A and/or B", when used in conjunction with open-ended language such as "comprising" can refer, in one embodiment, to A only (optionally including elements other than B); in another embodiment, to B only (optionally including elements other than A); in yet another embodiment, to both A and B (optionally including other elements); etc.

As used herein in the specification and in the claims, "or" should be understood to have the same meaning as "and/or" as defined above. For example, when separating items in a list, "or" or "and/or" shall be interpreted as being inclusive, i.e., the inclusion of at least one, but also including more than one, of a number or list of elements, and, optionally, additional unlisted items. Only terms clearly indicated to the contrary, such as "only one of" or "exactly one of," or, when used in the claims, "consisting of," will refer to the inclusion of exactly one element of a number or list of elements. In general, the term "or" as used herein shall only be interpreted as indicating exclusive alternatives (i.e. "one or the other but not both") when preceded by terms of exclusivity, such as "either," "one of," "only one of," or "exactly one of." "Consisting essentially of," when used in the claims, shall have its ordinary meaning as used in the field of patent law.

Unless otherwise indicated, all numbers expressing quantities of ingredients, properties such as reaction conditions, and so forth used in the specification and claims are to be understood as being modified in all instances by the term "about". Accordingly, unless indicated to the contrary, the numerical parameters set forth in this specification and claims are approximations that can vary depending upon the desired properties sought to be obtained by the presently-disclosed subject matter.

As used herein, the term "about," when referring to a value or to an amount of mass, weight, time, volume, concentration or percentage is meant to encompass variations of in some embodiments ±20%, in some embodiments ±10%, in some embodiments ±5%, in some embodiments ±1%, in some embodiments ±0.5%, and in some embodiments ±0.1% from the specified amount, as such variations are appropriate to perform the disclosed method.

As used herein, ranges can be expressed as from "about" one particular value, and/or to "about" another particular value. It is also understood that there are a number of values disclosed herein, and that each value is also herein disclosed as "about" that particular value in addition to the value itself. For example, if the value "10" is disclosed, then "about 10" is also disclosed. It is also understood that each unit between two particular units are also disclosed. For example, if 10 and 15 are disclosed, then 11, 12, 13, and 14 are also disclosed.

As used herein in the specification and in the claims, the phrase "at least one," in reference to a list of one or more elements, should be understood to mean at least one element selected from any one or more of the elements in the list of elements, but not necessarily including at least one of each and every element specifically listed within the list of elements and not excluding any combinations of elements in the list of elements. This definition also allows that elements may optionally be present other than the elements specifically identified within the list of elements to which the phrase "at least one" refers, whether related or unrelated to those elements specifically identified. Thus, as a non-limiting example, "at least one of A and B" (or, equivalently, "at least one of A or B," or, equivalently "at least one of A and/or B") can refer, in one embodiment, to at least one, optionally including more than one, A, with no B present (and optionally including elements other than B); in another embodiment, to at least one, optionally including more than one, B, with no A present (and optionally including elements other than A); in yet another embodiment, to at least one, optionally including more than one, A, and at least one, optionally including more than one, B (and optionally including other elements); etc.

It should also be understood that, unless clearly indicated to the contrary, in any methods claimed herein that include more than one step or act, the order of the steps or acts of the method is not necessarily limited to the order in which the steps or acts of the method are recited.

In the claims, as well as in the specification above, all transitional phrases such as "comprising," "including," "carrying," "having," "containing," "involving," "holding," "composed of," and the like are to be understood to be open-ended, i.e., to mean including but not limited to. Only the transitional phrases "consisting of" and "consisting essentially of" shall be closed or semi-closed transitional phrases, respectively, as set forth in the United States Patent Office Manual of Patent Examining Procedures.

Certain terminology is used in the following description for convenience only and is not limiting. The words "right," "left," "top," and "bottom" designate directions in the drawings to which reference is made. The words "a" and "one" are defined as including one or more of the referenced item unless specifically stated otherwise. This terminology includes the words above specifically mentioned, derivatives thereof, and words of similar import. The phrase "at least one" followed by a list of two or more items, such as A, B, or C, means any individual one of A, B or C as well as any combination thereof.

The foregoing description of methods and embodiments has been presented for purposes of illustration. It is not intended to be exhaustive or to limit the invention to the precise steps and/or forms disclosed, and obviously many modifications and variations are possible in light of the above teaching. It is intended that the scope of the invention and all equivalents be defined by the claims appended hereto.

The invention claimed is:

1. An insulated container, comprising:

a lid;

a body, said body comprising:

a rigid inner liner having a bottom, a sidewall extending upwardly from the bottom, said sidewall having a first end at the bottom and a second end spaced away from said bottom;

an upper opening defined by said second end of said sidewall;

a collar disposed near said second end of said sidewall, said collar forming a space between said sidewall and said collar;

a skirt assembly disposed over said rigid inner liner, said skirt assembly having a skirt ring at an upper end, said skirt ring engaging said collar, and a softside material depending from said skirt ring and covering said rigid inner liner;

a handle engaging said collar and said skirt ring to retain said skirt assembly in position over said rigid inner liner.

2. The insulated container of claim 1, said lid covering said upper opening.

3. The insulated container of claim 2, said sidewall having one or more locating features for the lid.

4. The insulated container of claim 1, further comprising said skirt ring comprising an ear having an aperture.

5. The insulated container of claim 4, said ear extending into said space formed by said collar.

6. The insulated container of claim 5, further comprising a pivot connector engaging said collar and said ear.

7. The insulated container of claim 1 further comprising one or more pockets formed on said skirt assembly.

8. The insulated container of claim 1, further comprising a foam insulation in said skirt assembly.

9. The insulated container of claim 8, further comprising said softside material being a fabric and disposed about an exterior of said foam insulation.

10. The insulated container of claim 1, further comprising one or more accessory retainers.

11. The insulated container of claim 10, further comprising accessories which connect to said one or more accessory retainers.

12. An insulated container, comprising:

a body having:

a rigid inner liner formed of a sidewall with an upper open end and a lower end connected to the sidewall;

a collar disposed at said upper open end of said sidewall;

a skirt assembly having an exterior material disposed between a skirt ring and a molded base;

a lid positioned at the upper open end of said sidewall;

a handle having L-shaped ends which connect said handle and said body;

said handle being pivotable from a first position which the lid is removable, to second and third positions wherein one of the second or third positions is for carrying and locks the lid, and the other of the second or third positions locks the lid;

a pivot connector extending between said collar, said skirt ring, and said handle, said pivot connector extending through said skirt ring.

13. The insulated container of claim 12, further comprising said pivot connector extending through said handle and into said collar.

14. The insulated container of claim 13, said pivot connector extending through said collar and said skirt ring.

15. The insulated container of claim 14, said skirt ring disposed adjacent to said collar, and having an ear which aligns with a hole in said collar to receive said pivot connector.

16. An insulated container, comprising:

a lid;

a body, said lid pivotally connected to said body, said body comprising:

a rigid inner shell liner comprising an inner base, and one or more inner sidewalls extending from said inner base;

a collar disposed at an upper end of the one or more inner sidewalls and extending outwardly therefrom, said collar forming a space between an outer surface of said one or more inner sidewalls and said collar;

a skirt assembly comprising a skirt ring and a softshell skirt material depending from said skirt ring, said skirt ring positioned within said space wherein said softshell skirt material covers said rigid inner shell liner;

a handle engaging said collar and said skirt ring to retain said skirt assembly in position over said rigid inner shell liner.

17. The insulated container of claim 16, said skirt ring comprising a retention structure.

18. The insulated container of claim 17, said collar comprising a hole which aligns with said retention structure when said skirt ring is positioned in said space.

19. The insulated container of claim 18, said handle having a pivot pin which extends through said retention structure and said hole in said collar to retain said skirt ring and said softshell skirt material in position within said collar.

20. The insulated container of claim 16, said handle comprising first and second buckles which pivotally connects to said body.

21. The insulated container of claim 20, said handle further comprising first and second handle arms connected to said first and second buckles, respectively.

22. The insulated container of claim 21 further comprising a handlebar extending between said first and second handle arms.

23. The insulated container of claim 16, said lid further comprising a softside lid material.

24. The insulated container of claim 23, said lid further comprising a closure.

25. The insulated container of claim 16, said lid being rectangular and said body having a corresponding rectangular shape.

26. The insulated container of claim 16, said handle comprising a rigid structure or a shoulder strap.

27. The insulated container of claim 16, said handle being interchangeable with a strap.

28. The insulated container of claim 27, said strap having a pad.

29. The insulated container of claim 28, said pad further comprising a hook which is movable relative to said pad.

* * * * *